US006976803B2

(12) United States Patent
Hirota et al.

(10) Patent No.: US 6,976,803 B2
(45) Date of Patent: Dec. 20, 2005

(54) STATIONARY BOARD FOR BLOCKING LIGHTS OF ONCOMING VEHICLES IN MEDIAL STRIP AND FACILITATING NIGHTTIME IDENTIFICATION OF MEDIAL STRIP

(75) Inventors: Kashichi Hirota, Tokyo (JP); Junji Fukuda, Tokyo (JP)

(73) Assignee: Kyowa Electric and Chemical Co., Ltd., Tokyo (JP)

( * ) Notice: Subject to any disclaimer, the term of this patent is extended or adjusted under 35 U.S.C. 154(b) by 0 days.

(21) Appl. No.: 10/923,994

(22) Filed: Aug. 23, 2004

(65) Prior Publication Data

US 2005/0019097 A1 Jan. 27, 2005

Related U.S. Application Data

(63) Continuation-in-part of application No. 10/600,558, filed on Jun. 20, 2003, now abandoned.

(30) Foreign Application Priority Data

Mar. 28, 2003 (JP) ..... 2003-090078
May 31, 2004 (JP) ..... 2004-160768

(51) Int. Cl.[7] ..... E01F 9/015
(52) U.S. Cl. ..... 404/9; 116/63 R
(58) Field of Search ..... 404/6, 9, 10, 12, 404/13, 14, 15, 16; 116/63 R, 63 P

(56) References Cited

U.S. PATENT DOCUMENTS 5,816,737 A 10/1998 Siblik
6,267,530 B1 7/2001 Attar
6,505,994 B1 1/2003 Attar
6,602,021 B1 8/2003 Kim
6,637,973 B1 10/2003 Kim
2002/0025222 A1 2/2002 Attar
2002/0159835 A1 10/2002 Attar
2002/0197108 A1 12/2002 Attar
2003/0016997 A1 1/2003 Attar

FOREIGN PATENT DOCUMENTS

JP 58-85611 6/1983
JP 10-82023 3/1998

*Primary Examiner*—Meredith Petravick
*Assistant Examiner*—Alexandra Pechhold
(74) *Attorney, Agent, or Firm*—Cohen, Pontani, Lieberman & Pavane

(57) ABSTRACT

A stationary board adapted to be set up in a medial strip between traffic lanes to block lights of oncoming vehicles in the medial strip and facilitate identification of the medial strip in nighttime driving or riding. This stationary board comprises a pair of plate members each composed of a molded component made of a transparent plastic material, and the plate members are coupled with one another at the respective marginal edges thereof to form an integrated assembly having a hollow space therein. Each of the plate members is formed with irregularities in its inner surface facing the hollow space of the assembly. A top member molded of a plastic material is attached to the top portion of the assembly in a fitting manner. The plastic material of the top member contains a luminous pigment capable of absorbing, storing and emitting light. The stationary board of the present invention can bring out a function of facilitating identification of the medial strip in nighttime driving or riding as well as blocking lights of oncoming vehicles, while offering excellent aesthetic appearance.

6 Claims, 12 Drawing Sheets

5
6
7
8
9
10
11
12
13
14
15
16
18
P

STATIONARY BOARD FOR BLOCKING LIGHTS OF ONCOMING VEHICLES IN MEDIAL STRIP AND FACILITATING NIGHTTIME IDENTIFICATION OF MEDIAL STRIP

CROSS-REFERENCE TO RELATED APPLICATIONS

This is a continuation-in-part of U.S. patent application Ser. No. 10/600,558 filed Jun. 20, 2003, now abandoned, which is based on Japanese Patent Application Nos. 2003-090078 and 2004-160768, filed Mar. 28, 2003 and May 31, 2004 respectively, the entire contents of which are incorporated herein by reference.

FIELD OF THE INVENTION

The present invention relates to a stationary board to be set up in a medial strip at given intervals in multilane divided highways or ordinary roads. In particular, the present invention relates to a stationary board capable of blocking lights of oncoming vehicles and effective to facilitate identification of the presence of a medial strip between traffic lanes in nighttime driving.

BACKGROUND OF THE INVENTION

It is often the case that during driving a motor vehicle such as automobile or motorcycle in the lane facing oncoming traffic, the lights of oncoming vehicles can dazzle a driver or rider and negatively influence his/her driving or riding at nighttime. In view of this risk, various types of barriers are set up in a medial strip of a highway.

Such barriers include a simple type composed of plural pairs of plate members with opposite colors to be alternately set up in a medial strip at given intervals to provide enhanced anti-dazzling effect and visibility (see Japanese Utility Model Laid-Open Publication No. 58-85611). There has also been known a common technique of applying a luminous paint or the like onto road or traffic signs to effectively provide enhanced visibility in dark places (see, for example, Japanese Patent Laid-Open Publication No. 10-82023).

However, the anti-dazzling plate disclosed in the above Japanese Utility Model Laid-Open Publication No. 58-85611 is designed to simply achieve its intended purpose of preventing dazzle. A luminous road-sign material disclosed in the above Japanese Patent Laid-Open Publication No. 10-82023 is intended to be limitedly used as a line for zoning a road or indicating a dangerous zone, in darkness such as nighttime.

As above, conventionally employed barriers are intended to provide only a light-blocking effect. Thus, they are limited in functionality, and far from excellent in appearance.

SUMMARY OF THE INVENTION

It is therefore an object of the present invention to provide a stationary board for a medial strip between traffic lanes, capable of bringing out a function of facilitating identification of the medial strip in nighttime driving or riding as well as blocking lights of oncoming vehicles, while offering excellent aesthetic appearance, and capable of being produced in an extremely simplified process at a low cost.

In order to achieve the above object, according to a first aspect of the present invention, there is provided a stationary board adapted to be set up in a medial strip between traffic lanes to block lights of oncoming vehicles in the medial strip and facilitate identification of the medial strip in nighttime driving or riding. This stationary board comprises a pair of plate members each composed of a molded component made of a transparent plastic material, and the plate members are coupled with one another at the respective marginal edges thereof to form an integrated assembly having a hollow space therein. Each of the plate members is formed with irregularities in its inner surface facing the hollow space of the assembly, and at least the marginal region of the inner surface has a coat layer of a luminous material thereon. The stationary board is arranged such that the central plane of the plate assembly has an inclination in the range of 10° to 20° relative to a direction perpendicular to the longitudinal direction of the medial strip.

According to a second aspect of the present invention, there is provided a stationary board adapted to be set up in a medial strip between traffic lanes to block lights of oncoming vehicles in the medial strip and facilitate identification of the medial strip in nighttime driving or riding. This stationary board comprises a pair of plate members each composed of a molded component made of a transparent plastic material, and the plate members are coupled with one another at the respective marginal edges thereof to form an integrated assembly having a hollow space therein. Each of the plate members is formed with irregularities in its inner surface facing the hollow space of the assembly, and at least the marginal region of the inner surface has a coat layer of a luminous material thereon. Further, each of the plate members has a central region and a peripheral region on the outside of the central region. The central region has a flat shape, and the inner surface of the central region is formed as a rough surface with fine irregularities. The peripheral region has an arc shape in horizontal section, and the inner surface of the peripheral region is formed with a number of pyramid-shaped protrusions in its entirely. The fine irregularities and the protrusions serve as the aforementioned irregularities.

Typically, the stationary board set forth in the above first or second aspect of the present invention may have a height of 600 to 700 mm and a width of 400 to 450 mm. In use, the stationary board may be set up in the medial strip through a column support in such manner that it is located at a height of 1400 to 1500 mm. The distance between the adjacent stationary boards may be set in the range of 2 to 5 m. While the plastic material constituting the plate members is preferably acrylic or polycarbonate, any other suitable transparent plastic material may also be used. The plastic material may be colorless or colored.

When set up in the medial strip at given intervals, the stationary board set forth in the first or second aspect of the present invention is operative to scatter the lights of vehicles in the opposite lane at nighttime by the irregularities formed in the inner surfaces of the plate members constituting the stationary board. Thus, a driver or rider can drive a motor vehicle without dazzle or negative influence from the lights of oncoming vehicles, which improves safety in driving. In addition, the coat layer of a luminous material formed on at least the marginal regions of the inner surfaces of the plate members allows the marginal portion of the stationary board to emit light at nighttime so as to help identify the position of the medial strip. As compared to a case where the coat layer of a luminous material is formed over an extended range, for example, in the entire inner surfaces of the plate members, the coat layer of a luminous material formed on only the marginal regions of the inner surfaces provides reduced brightness or luminance of the stationary board to prevent the stationary board from emitting excessive or dazzling light. While it is desirable to form the coat layer of a luminous material on only the marginal regions for the above reason, the present invention is not limited thereto.

Further, the stationary board set forth in the first aspect of the present invention is arranged such that the central plane of the plate assembly has an inclination in the range of 10° to 20° relative to a position perpendicular to the longitudinal direction of the medial strip. This arrangement can reduce wind pressure to be applied to the stationary board during passing of motor vehicles. The central plane may be inclined in either of rightward and leftward directions to obtain the same effect. This arrangement may be applied to the stationary board set forth in the second aspect of the present invention.

In order to achieve the above object, according to a third aspect of the present invention, there is provided a stationary board adapted to be set up in a medial strip between traffic lanes to block lights of oncoming vehicles in the medial strip and facilitate identification of the medial strip in nighttime driving or riding. This stationary board comprises a pair of plate members each composed of a molded component made of a transparent plastic material, and the plate members are coupled with one another at the respective marginal edges thereof to form an integrated assembly having a hollow space therein. Each of the plate members is formed with irregularities in its inner surface facing the hollow space of the assembly. The stationary board further includes a top member molded of a plastic material and attached to the top portion of the assembly in a fitting manner. The plastic material of the top member contains a photoluminescent or luminous pigment capable of absorbing, storing and emitting light. Preferably, the mixing ratio of the luminous pigment to the plastic resin material is set in the range of about 5 to about 15 wt %.

In the stationary board set forth in the third aspect of the present invention, the plastic molded top member to be attached to the top portion of the assembly may have a plurality of pawls, and the assembly may be formed with a depression at a position allowing the pawls to be received therein. In this case, the assembly and the plastic molded top member can be fastened together by fitting the pawls of the top member into the depression of the assembly. The top portion of the assembly may further be formed with an insertion hole for receiving a screw therein. In this case, after completion of the above fitting operation of the plastic molded top member, a screw can be driven into the insertion hole of the assembly to assure the engagement between the plastic molded top member and the assembly.

In the stationary board set forth in the third aspect of the present invention, each of the plate members may have a central region formed in a flat shape, and a peripheral region located on the outside of the central region and formed in an arc shape in horizontal section. Further, the inner surface of the central region may be formed as a rough surface with fine irregularities, and the inner surface of the peripheral region may be formed with a number of pyramid-shaped protrusions in its entirely. The fine irregularities and the protrusions serve as the aforementioned irregularities.

Typically, the stationary board set forth in the third aspect of the present invention may have a height of 600 to 700 mm and a width of 400 to 450 mm. In use, the stationary board may be set up in the medial strip through a column support in such manner that it is located at a height of 1400 to 1500 mm. The distance between the adjacent stationary boards may be set in the range of 2 to 5 m. While the plastic material constituting the plate members is preferably acrylic or polycarbonate, any other suitable transparent plastic material may also be used. The plastic material may be colorless or colored.

The stationary board set forth in the third aspect of the present invention may be arranged such that the horizontal central line of the plate assembly has an inclination in the range of 10° to 20° relative to a direction perpendicular to the longitudinal direction of the medial strip.

When set up in the medial strip at given intervals, the stationary board set forth in the third aspect of the present invention is operative to scatter the lights of vehicles in the opposite lane at nighttime by the irregularities formed in the inner surfaces of the plate members constituting the stationary board. Thus, a driver or rider can drive a motor vehicle without dazzle or negative influence from the lights of oncoming vehicles, which improves safety in driving. In addition, the top member molded of a plastic resin material containing a luminous pigment and attached to the top portion of the plate assembly serves as an identification portion. Specifically, the top member of the stationary board emits light based on energy stored therein in the daytime to help drivers or riders recognize or identify the position of the medial strip. While the luminous identification portion is formed at only the upper portion of the stationary board, it is sufficiently capable of allowing the stationary board to be visually identified even in nighttime. Furthermore, as compared to a technique of simply applying a luminous paint onto a stationary board, the identification portion formed of plastic resin containing a luminous pigment exhibits excellent durability in natural conditions, such as exposure to sunlight for a long time or exposure to wind and rainwater.

As mentioned above, the stationary board set forth in the third aspect of the present invention may be arranged such that the central plane of the plate assembly has an inclination in the range of 10° to 20° relative to a position perpendicular to the longitudinal direction of the medial strip. This arrangement can reduce wind pressure to be applied to the stationary board during passing of motor vehicles. The central plane may be inclined in either of rightward and leftward directions to obtain the same effect.

In addition to the aforementioned advantages, the stationary board set forth in the third aspect of the present invention has a main body composed of a molded component made of a transparent plastic material, and a luminous identification portion formed by attaching the luminous-pigment-containing plastic molded top member to the main body. Thus, the stationary board can be produced in a simplified process at a low cost. Further, the stationary board generally molded of a transparent plastic material is excellent in aesthetic appearance.

Other features and advantages of the present invention will be apparent from the accompanying drawings and from the detailed description.

Figure 3:
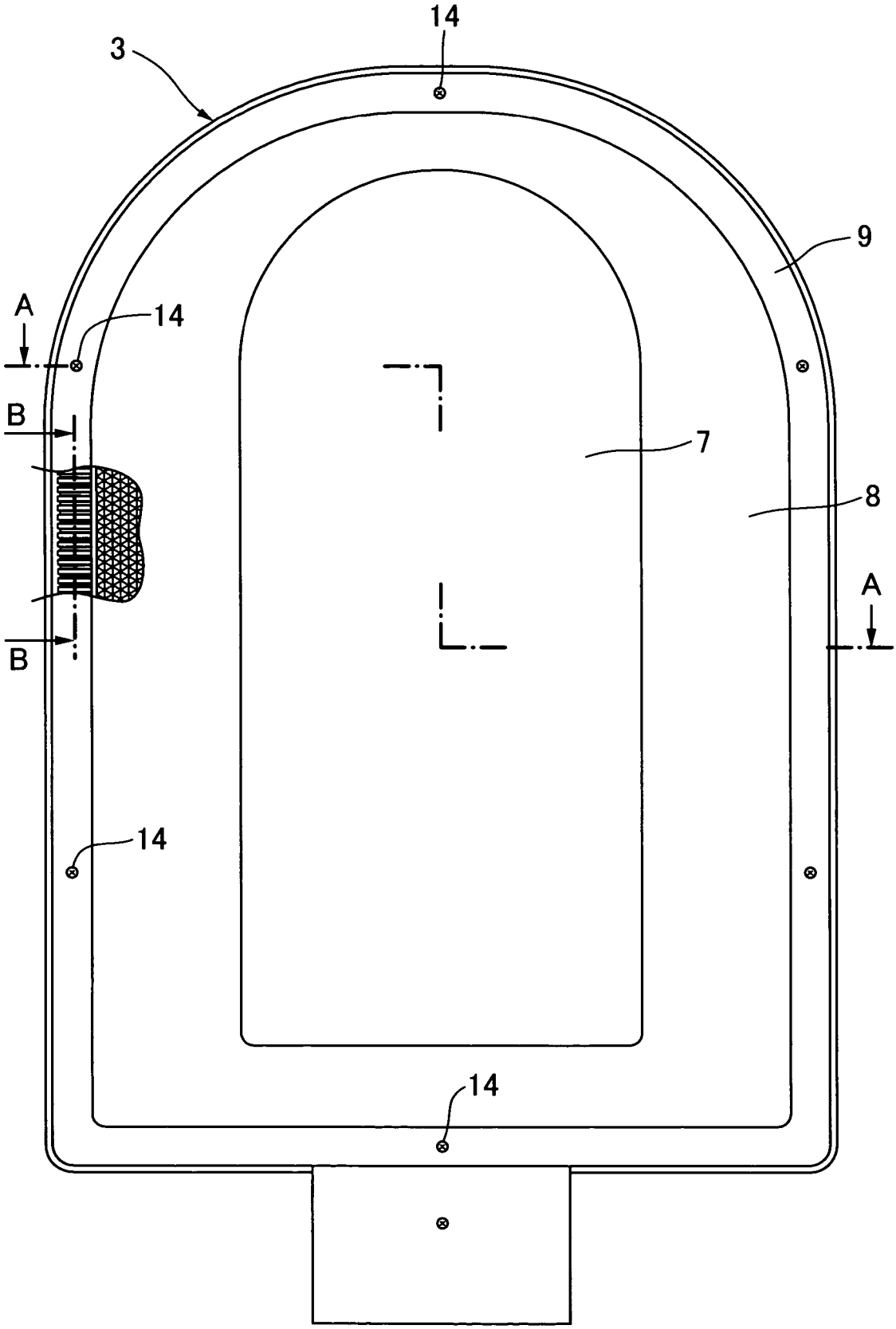
FIG. 3 is an enlarged front view showing a plate assembly of the stationary board in FIG. 2.
Figures 4A, 4B:
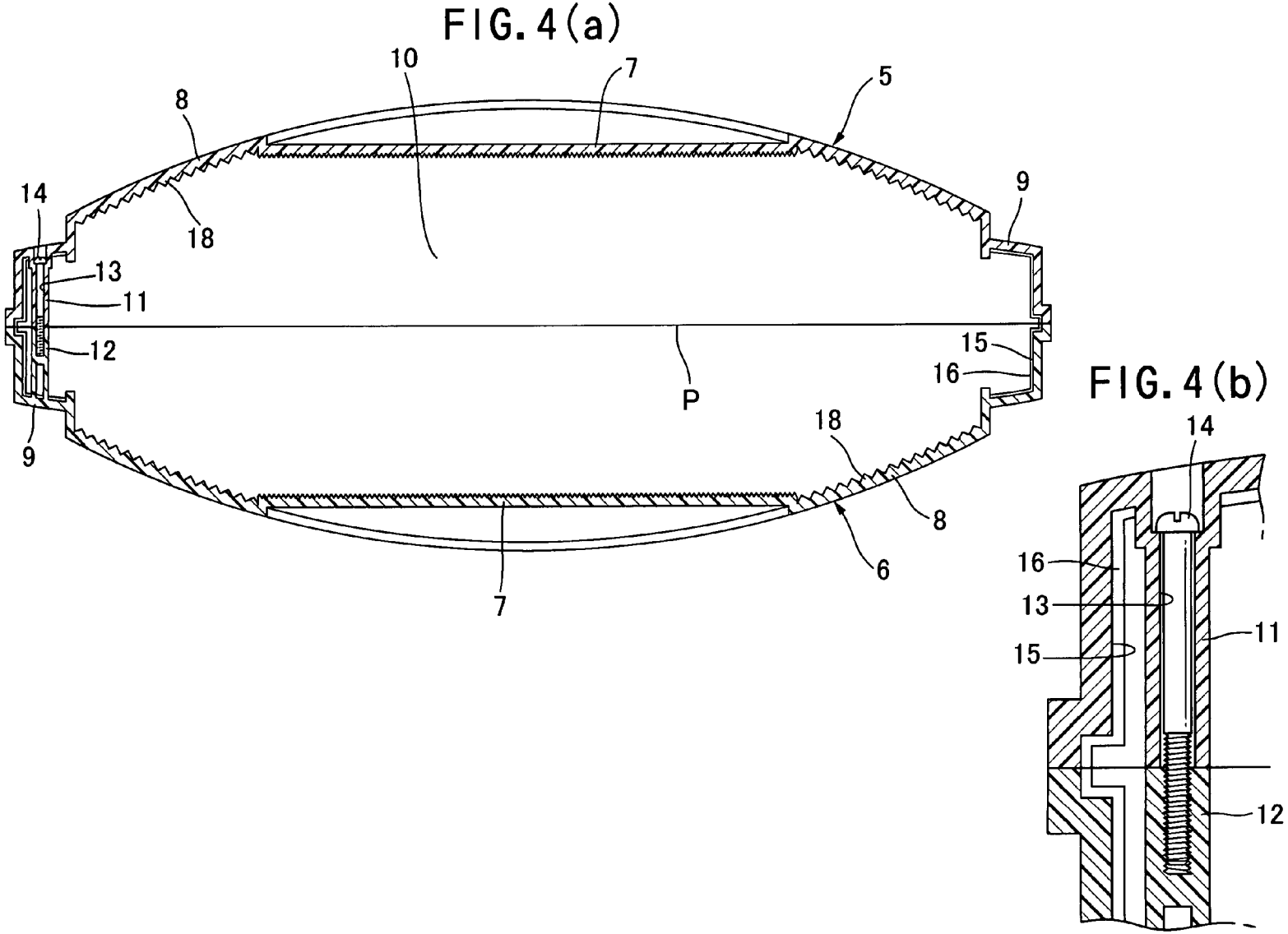
FIGS. 4(*a*) and 4(*b*) are sectional views showing the detailed structure of the stationary board, wherein FIG. 4(*a*)

is a sectional view taken along the line A—A in FIG. 3, and FIG. 4(*b*) is an enlarged sectional view showing a coupling structure at the marginal edge of the plate assembly.

Figure 5:
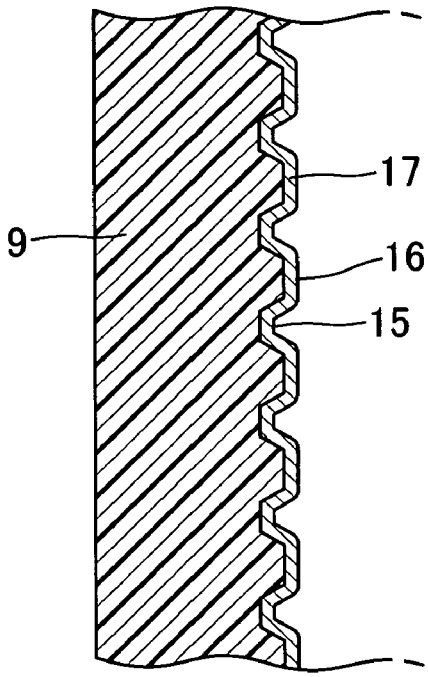

FIG. 5 is an enlarged sectional view taken along the line B—B in FIG. 3, which shows irregularities and a coat layer of a luminous material in the marginal region of the plate assembly.

Figure 6:
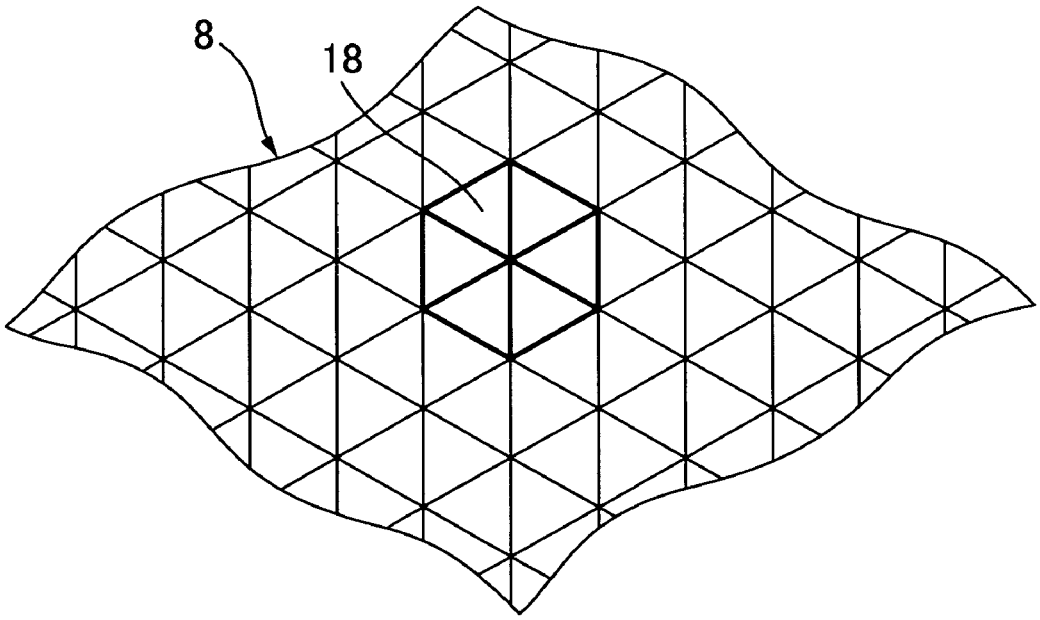

FIG. 6 is an enlarged view showing irregularities formed in the peripheral region of the inner surface of the plate assembly.

Figure 7:
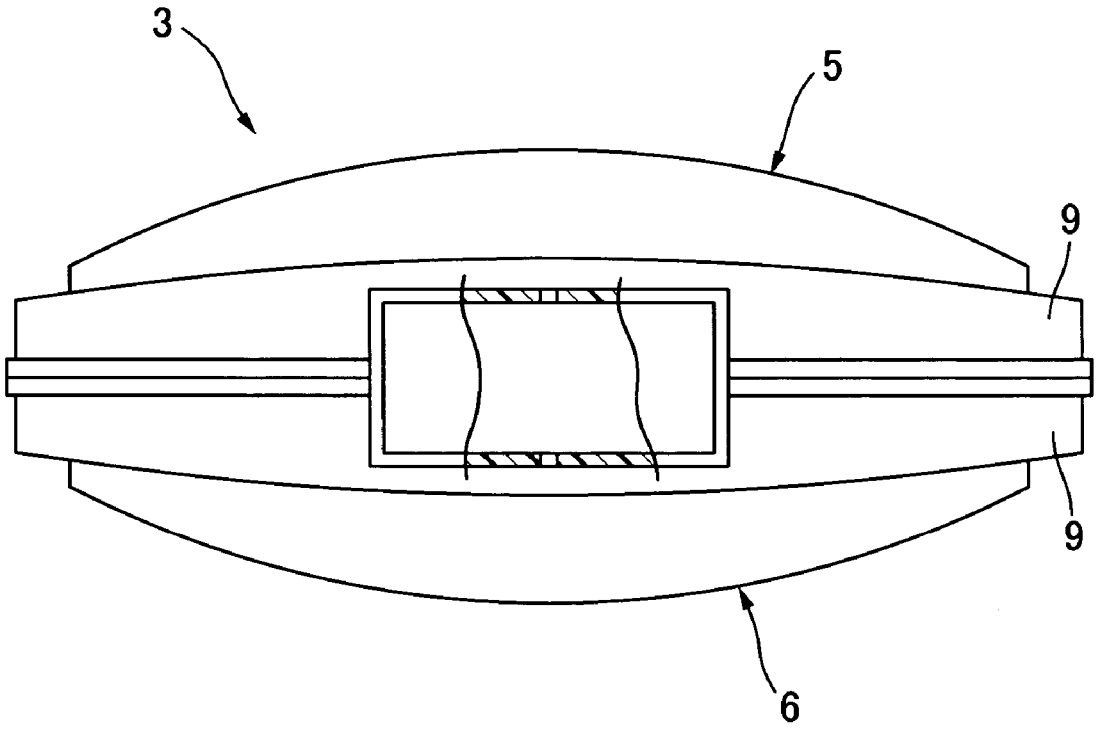

FIG. 7 is a bottom view of the stationary board, wherein a column support is partially cut out.

Figure 8:
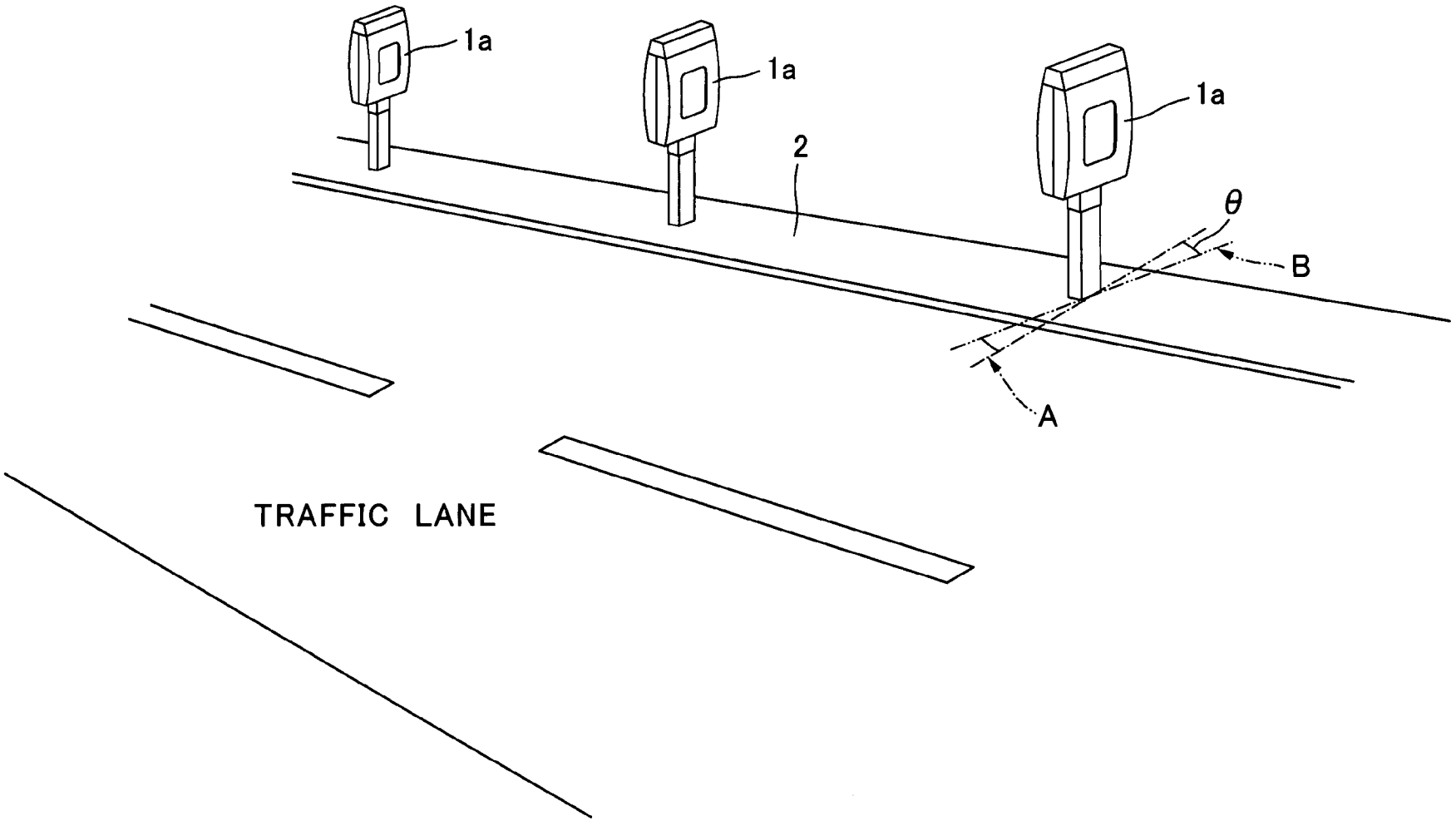

FIG. 8 is a perspective view showing a stationary board according to a second embodiment of the present invention, wherein a plural number of the stationary boards are set up along a medial strip between traffic lanes.

Figure 9:
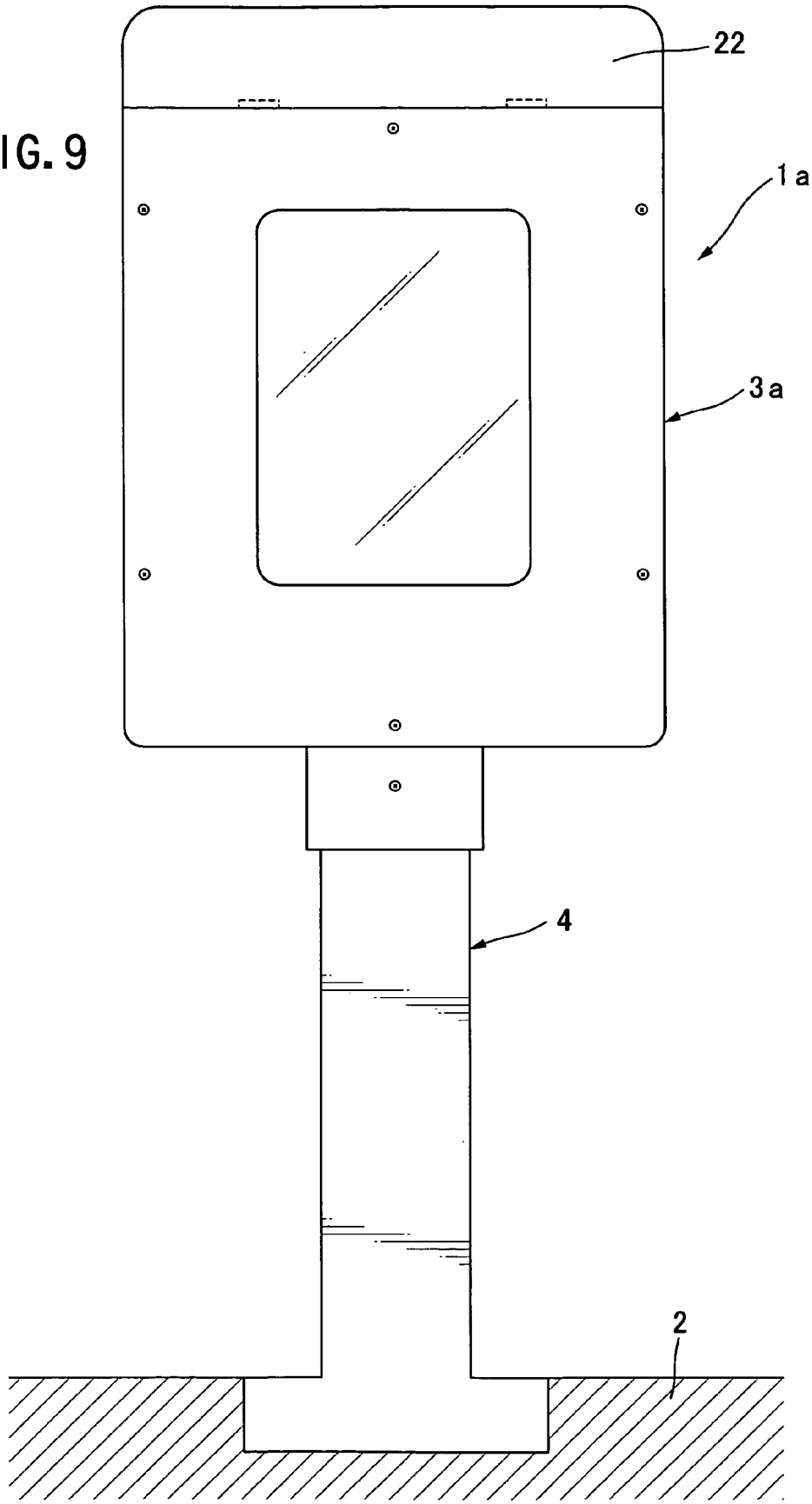

FIG. 9 is a front exterior view showing the stationary board in FIG. 8.

Figure 10:
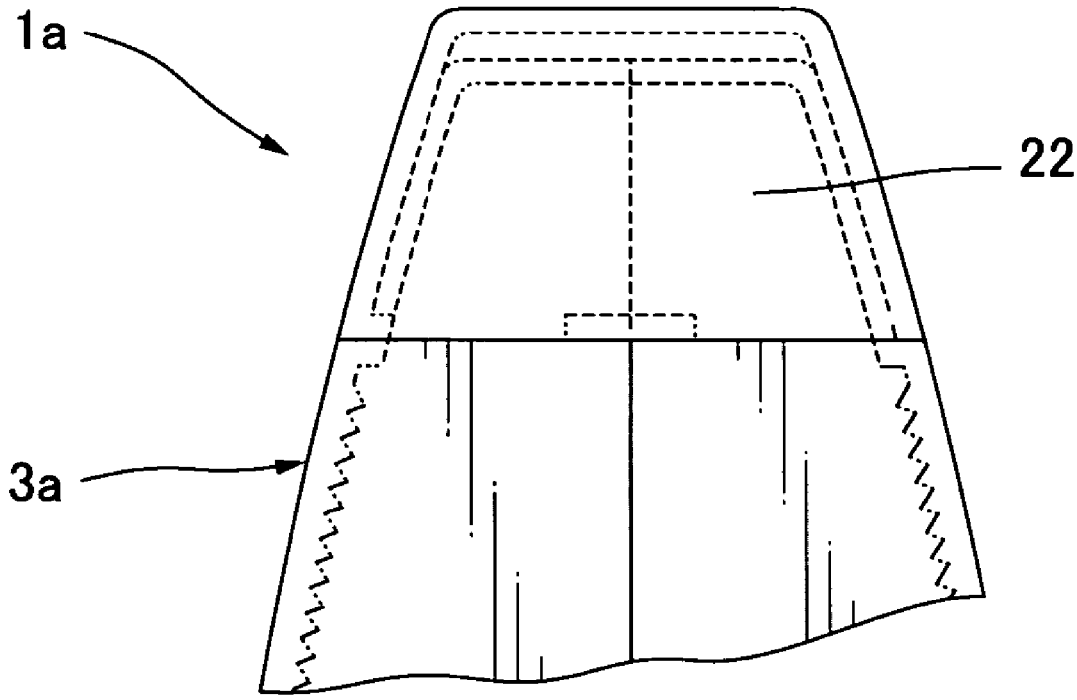

FIG. 10 is a sectional side view showing the upper region of the stationary board in FIG. 9.

Figure 11:
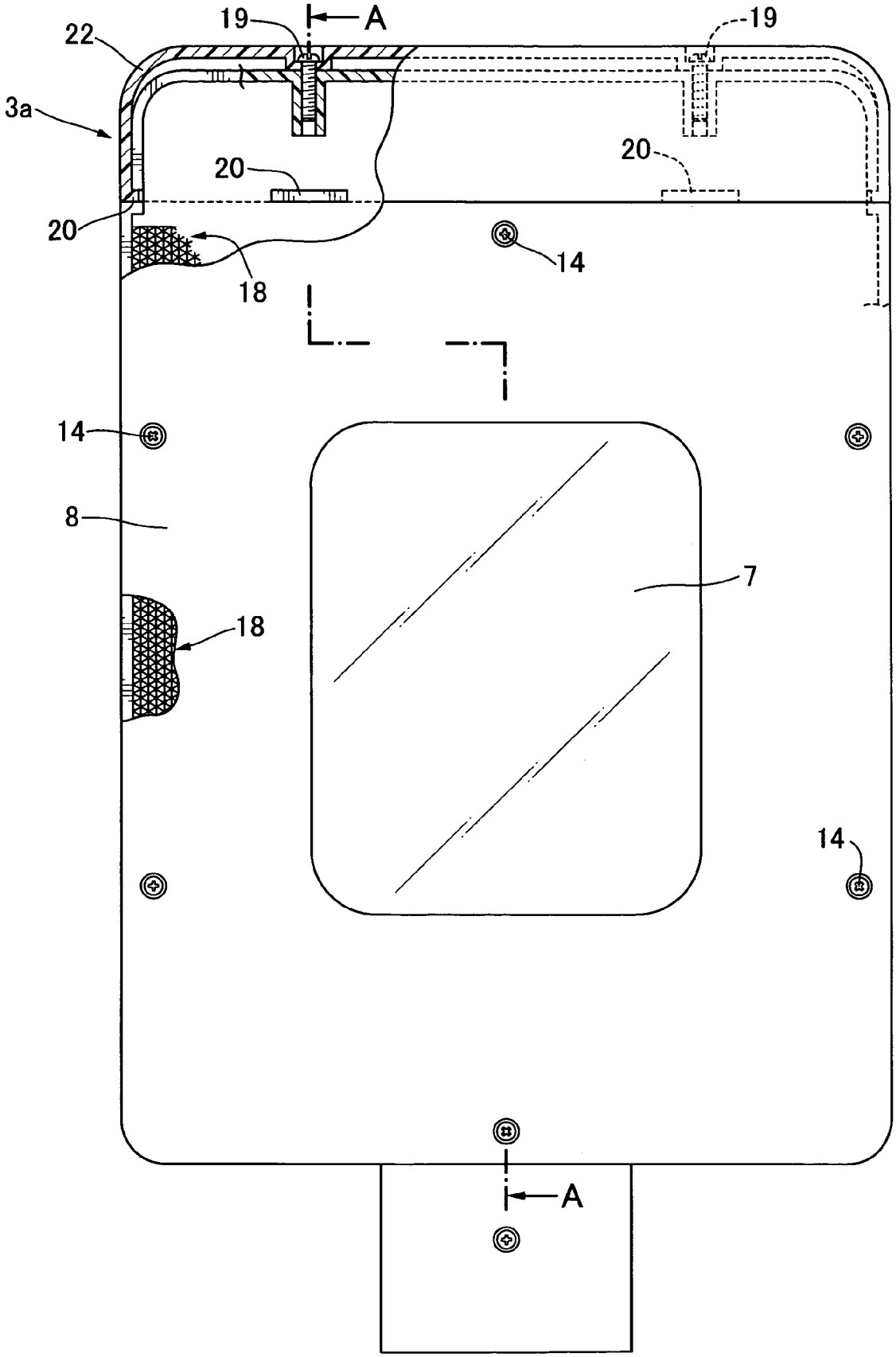

FIG. 11 is an enlarged front view showing a plate assembly of the stationary board in FIG. 9.

Figure 12:
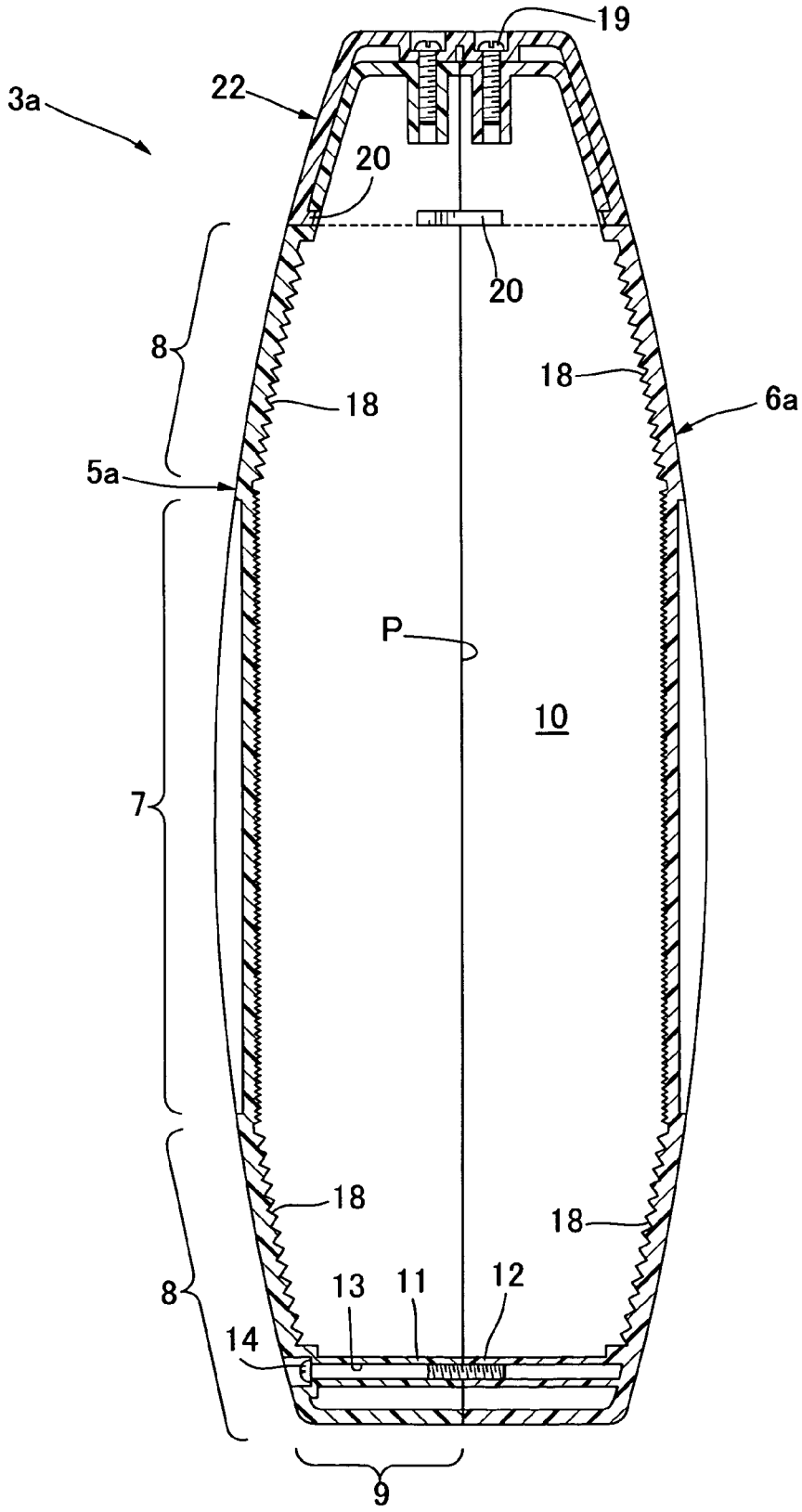

FIG. 12 is a sectional view showing the detailed structure of the stationary board, taken along the line A—A in FIG. 11.

Figure 13:
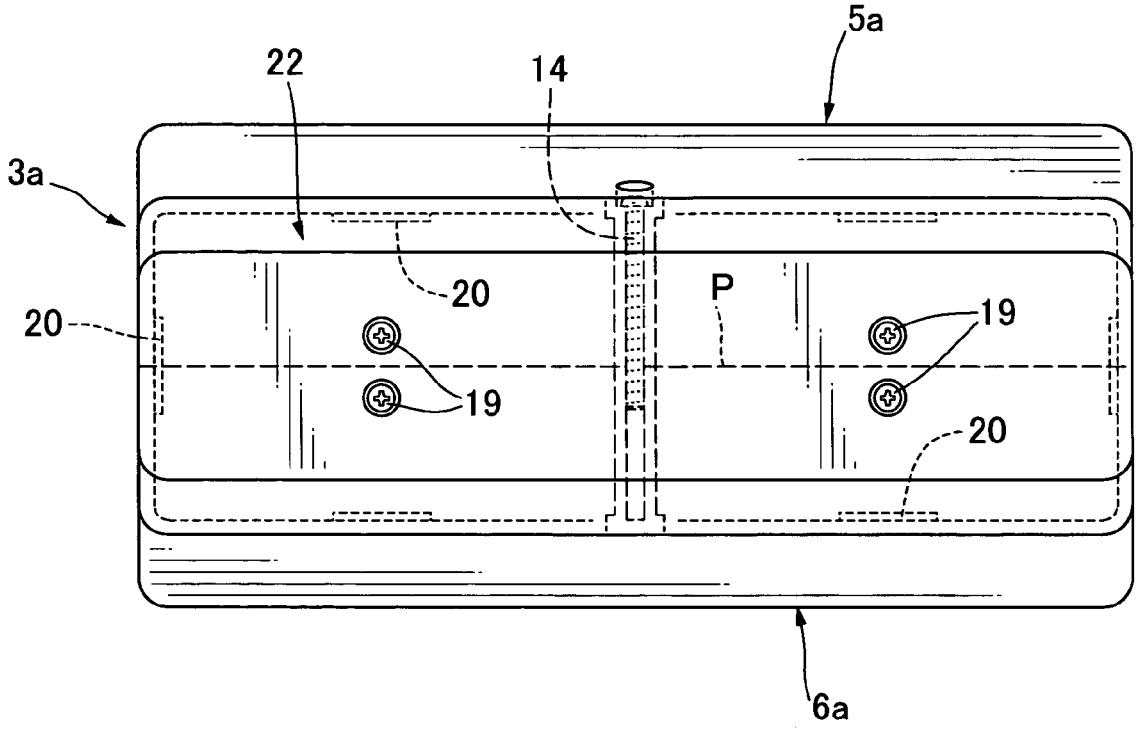

FIG. 13 is a top view showing the stationary board in FIG. 9.

DESCRIPTION OF THE PREFERRED EMBODIMENT

With reference to accompanying drawings, an embodiment of the present invention will now be described.

Figure 1:
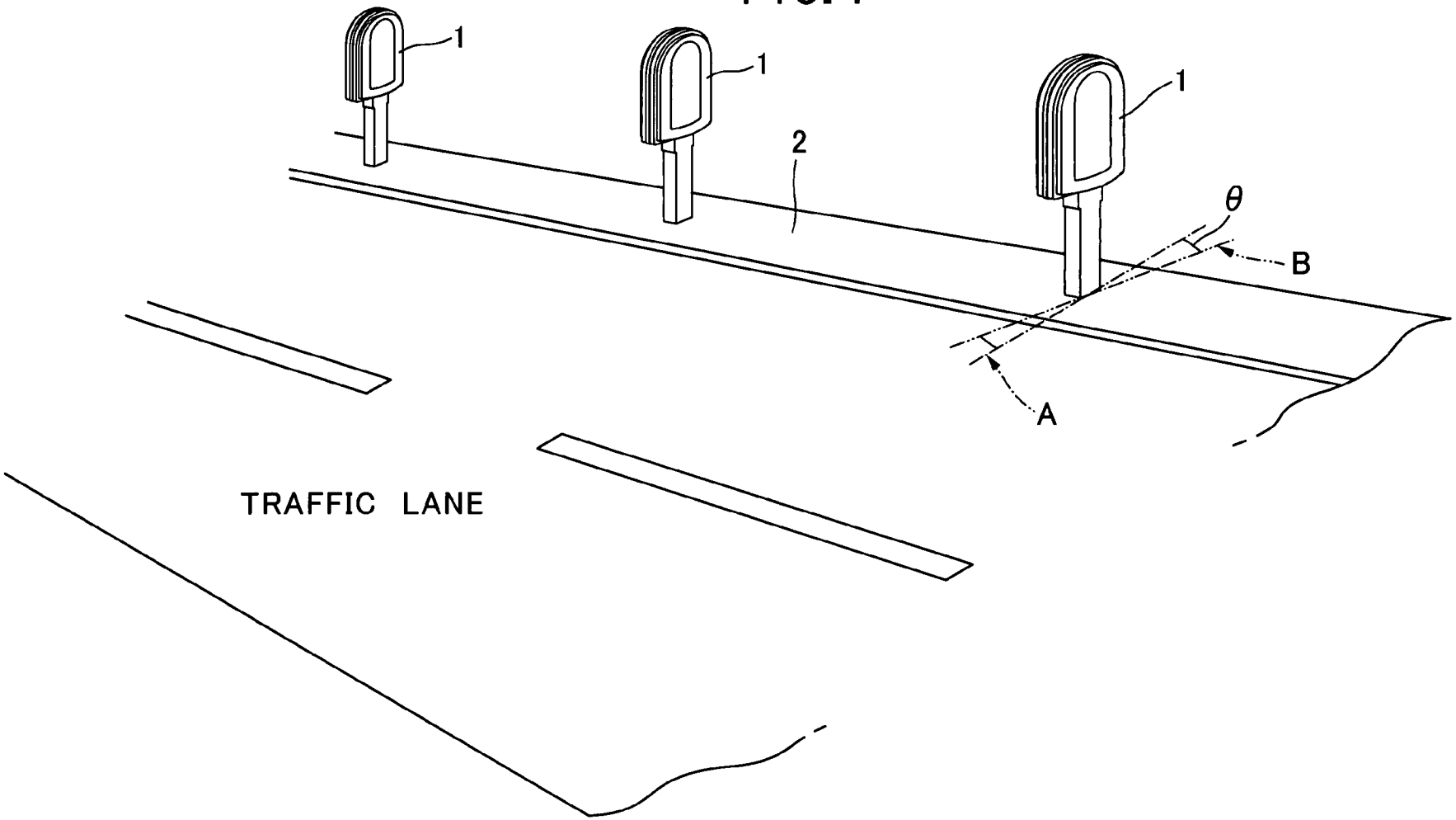
FIG. 1 is a perspective view showing a stationary board according to a first embodiment of the present invention, wherein a plural number of the stationary boards are set up along a medial strip between traffic lanes.

FIG. 1 shows a stationary board 1 according to a first embodiment of the present invention, wherein a plural number of the stationary boards 1 are set up along a medial strip 2 between traffic lanes at given intervals, for example, of 5 to 7 m. The stationary board 1 is set up in the medial strip 2 in such manner that the plane of the stationary board 1 is located approximately perpendicular to the longitudinal direction of the medial strip 2.

Figure 2:
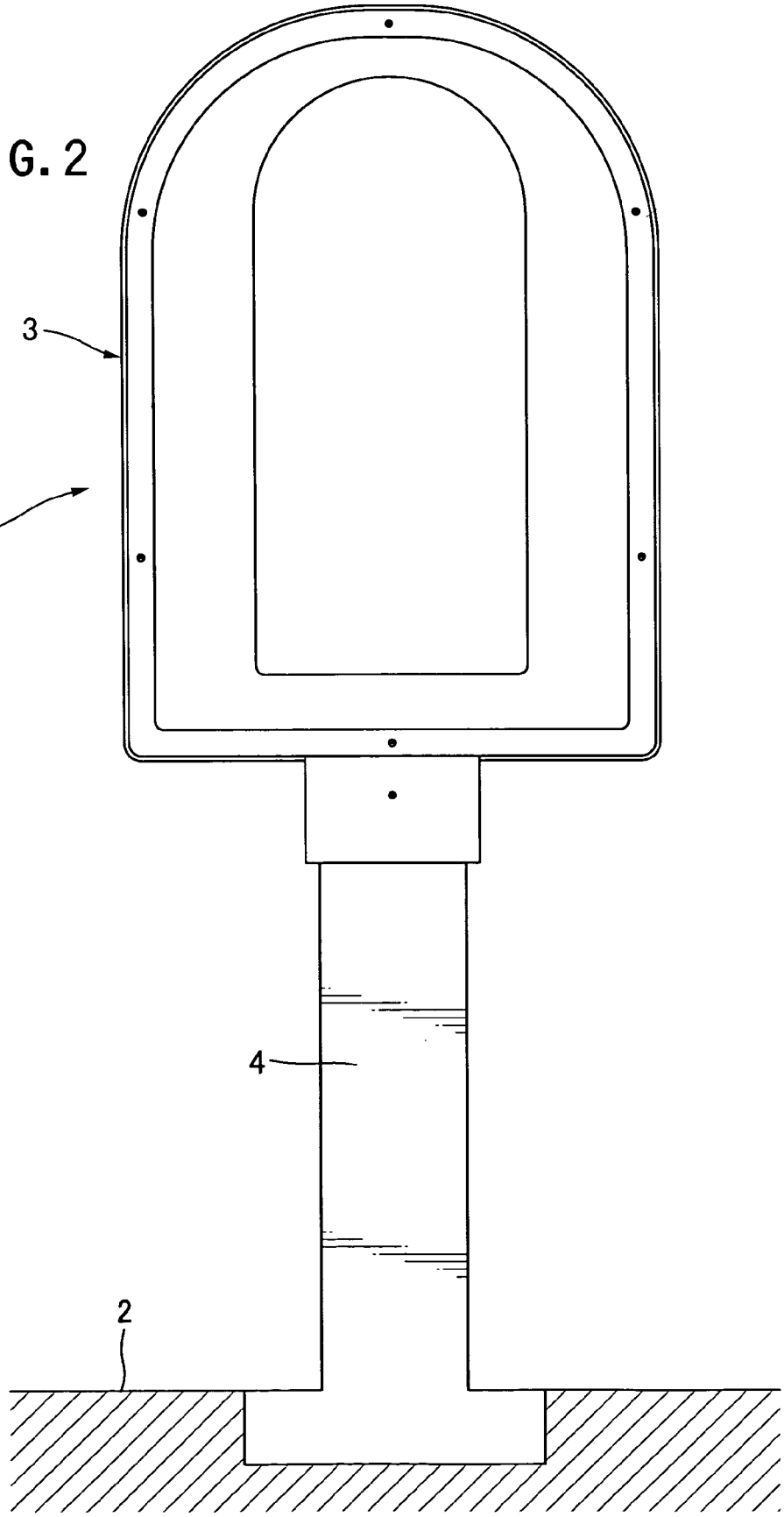
FIG. 2 is a front exterior view showing the stationary board in FIG. 1.

FIG. 2 is a front exterior view showing the stationary board 1. The stationary board 1 comprises a plate assembly 3 and a column support 4. As shown in FIG. 4(*a*) which is a sectional view taken along the line A—A in FIG. 3, the plate assembly 3 includes a pair of plate members 5, 6. Each of the plate members 5, 6 is molded of a transparent plastic material, such as acrylic or polycarbonate. As shown in FIG. 3 and FIG. 4(*a*), each of the plate members 5, 6 has a central region 7 having an approximately flat shape, a peripheral region 8 surrounding the central region 7, and a marginal region 9. The peripheral region 8 has an arc shape in horizontal section as shown in FIG. 4(*a*). The pair of plate members 5, 6 are coupled with each other at the edge of the marginal region 9 to form the assembly having a hollow space 10 therein. As shown at the left end of FIG. 4 (*a*) and in FIG. 4(*b*), the edge of the marginal region 9 of the plate member 5 is formed with a boss 11 having a screw-insertion hole 13, and the edge of the marginal region 9 of the plate member 6 is formed with a screw-receiving portion 12 at a position opposed to the boss 11. The two plate members 5, 6 are coupled together by driving a setscrew 14 into the screw-receiving portion 12 of the plate member 6 through the hole 13 formed in the boss 11 of the plate member 5. A plural number of the setscrews 14 are attached to the plate assembly along the marginal region 9 at appropriate intervals as shown in FIG. 3.

Referring to FIGS. 3 to 5, in each of the plate members 5, 6, a plurality of grooves 15 and protruded lines 16 are formed alternately in the inner surface of the entire marginal region 9 facing the hollow space to provide irregularities therein. Further, a coat layer 17 of a luminous martial is formed on the entire surface having the grooves 15 and the protruded lines 16. In each of the plate members 5, 6, the inner surface of the flat-shaped central region 7 is formed as a rough surface with fine irregularities as seen in FIG. 4(*a*), and the inner surface of the peripheral region 8 is formed with a number of protrusions 18 each having a six-sided pyramid shape as shown in FIG. 6 which is a fragmentary enlarged view of the inner surface of the peripheral region 8. In FIG. 6, one six-sided pyramid-shaped protrusion 18 is shown by a thick line. In FIG. 4(*a*), the reference symbol P indicates the central plane of the plate assembly 3.

FIG. 7 is a bottom view of the stationary board, wherein the column support 4 is partially cut out. The column support 4 is also formed in a hollow structure of a plastic martial. It is not essential to provide transparency in the column support.

In the medial strip 2 having a plural number of the above stationary boards 1 set up therealong at given intervals, for example, of 5 to 7 m, as shown in FIG. 1, the light from a vehicle in the opposite lane at night is incident on the surface of the plate assembly 3 of the stationary board 1. Then, the incident light is scattered by the irregularities formed in the inner surface of the central region 7 and the six-sided pyramid-shaped protrusions 18 formed in the inner surface of the peripheral region 8 in each of the plate members 5, 6. This scattering effect prevents the light of the oncoming vehicle from dazzling or negatively influencing a driver or rider in a lane facing the light. In addition, the coat layer 17 of a luminous material formed on the inner surface of the marginal region 9 in each of the plate members stores energy of exciting lights from outside to allow the marginal portion of the stationary board to emit light in dark condition so as to help drivers or riders identify the position of the medial strip.

Preferably, the plate assembly 3 of the stationary board 1 is designed to have a height of 600 to 700 mm and a width of 400 to 450 mm, and is set up in the medial strip through the column support 4 at a total height of 1400 to 1500 mm.

Referring to FIG. 1, the line A indicates a direction perpendicular to the longitudinal direction of the medial strip 2, and the line B indicated a projector of the plane of the plate members serving as a principal component of the stationary board 1. As seen in FIG. 1, the stationary board 1 is preferably arranged such that the central plane P of the plate assembly 3 has a given inclination e relative to the perpendicular direction A. Preferably, the inclination θ is set in the range of 10° to 20°.

With reference to FIGS. 8 to 13, a second embodiment of the present invention will be described below. In the following description, the same component of element as that in the first embodiment is defined by the same reference numeral or symbol.

FIG. 8 shows a stationary board 1*a* according to the second embodiment of the present invention, wherein a plural number of the stationary boards 1*a* are set up along a medial strip 2 between traffic lanes at given intervals, for example, of 5 to 7 m. The stationary board 1*a* is set up in the medial strip 2 in such manner that the plane of the stationary board 1*a* is located approximately perpendicular to the longitudinal direction of the medial strip 2.

FIG. 9 is a front exterior view showing the stationary board 1*a*. The stationary board 1*a* comprises a plate assembly 3*a* and a column support 4. Further, an identification member 22 is attached to the plate assembly 3*a* in a fitting manner so as to cover over the top portion of the plate assembly 3*a*. FIG. 10 is a sectional side view of the top portion of the plate assembly 3*a* in the state after the identification member 22 is attached thereto. FIG. 11 is a partially broken-out enlarged front view showing the plate assembly 3*a* of the stationary board 1*a* in FIG. 10. As shown in FIG. 12 which is a sectional view taken along the line A—A in FIG. 11, the plate assembly 3*a* includes a pair of plate members 5*a,* 6*a*. Each of the plate members 5*a,* 6*a* is molded of a transparent plastic material, such as acrylic or polycarbonate. As shown in FIGS. 11 and 12, each of the plate members 5*a,* 6*a* has a central region 7 having an approximately flat shape, a peripheral region 8 surrounding the central region 7, and a marginal region 9. The peripheral region 8 has an arc shape in horizontal section as shown in FIG. 12. The pair of plate members 5*a,* 6*a* are coupled with each other at the edge of the marginal region 9 to form the assembly having a hollow space 10 therein. As shown at the left end of FIG. 12, the edge of the marginal region 9 of the plate member 5 is formed with a boss 11 having a screw-insertion hole 13, and the edge of the marginal region 9 of the plate member 6 is formed with a screw-receiving portion 12 at a position opposed to the boss 11. The two plate members 5*a,* 6*a* are coupled together by driving a setscrew 14 into the screw-receiving portion 12 of the plate member 6 through the hole 13 formed in the boss 11 of the plate member 5*a*. A plural number of the setscrews 14 are attached to the plate assembly along the edge of the peripheral region 8 at appropriate intervals as shown in FIG. 11.

The identification member is attached to the plate assembly 3*a* in such a manner that it covers over the top portion of the plate assembly 3*a* composed of the plate members 5*a,* 6*a* fastened together with the plurality of setscrews 14. The identification member 22 is molded of a plastic resin material containing a luminous pigment capable of absorbing, storing and emitting light. As with the material of the plate members 5*a,* 6*a,* the plastic resin material suitable for use in the identification member 22 may include acrylic and polycarbonate. The luminous pigment to be contained in the plastic resin material may include, but not limited to, sulfurated lime, strontium sulfide and zinc sulfide. Preferably, the mixing ratio of the luminous pigment to the plastic resin material is set in the range of about 5 to about 15 wt %. Thus, the identification member 22 containing such a luminous pigment can absorb and store light during exposure to sunlight, ultraviolet light or lamp, and emit light based on the stored light energy, in a dark place where light rays are blocked off. As described later, even if the identification member 22 molded of a plastic resin material containing such a luminous material is used in a place where it is exposed to strong direct sunlight or wind/rainwater for a long time, it will exhibit excellent water resistance and durability, as compared to an identification portion formed by simply applying a luminous paint onto the plate assembly.

In order to attach the identification member 22 molded of a plastic resin material containing such a luminous material, to the top portion of the plate assembly 3*a,* the identification member 22 is formed with a pawl 20 to be fitted into the plate assembly 3*a,* and the plate assembly 3*a* is formed with a depression at positions allowing the pawl 20 to be received therein, as shown in FIGS. 11 and 12. Preferably, the pawl 20 is formed in a plural number to allow the identification member 22 to be fitted into and firmly fastened to the plate assembly 3*a*. While the identification member 20 in this embodiment is formed with six of the pawls 20 consisting of four pawls located, respectively, on the side of the front and rear surfaces of the plate assembly 3*a,* and two pawl located, respectively, on the side of the opposite side surfaces of the plate assembly 3*a,* the number of the pawls is not limited thereto. As seen in FIGS. 11 and 12 and FIG. 13 which is a top view of the plate assembly 3*a,* a screw 19 is driven into a screw-receiving portion formed on the top surface of the plate assembly 3*a* through a hole formed in the top surface of the identification 22 to introduce the screw 19. In this embodiment, four of the screw-receiving portions are formed in the plate assembly 3*a* at given intervals. The identification member 22 is first attached to the plate assembly 3*a* at a given position in a fitting manner using the pawls 20, and then the screws 19 are driven into the corresponding screw-receiving portions of the plate assembly 3*a* through the corresponding holes formed in the top surface of the identification member 22. In this manner, the identification member 22 can be reliably fastened to the plate assembly 3*a*.

As seen in FIGS. 11 and 12, the size of the identification member 22 may be designed such that, when the stationary board 1*a* according to the second embodiment of the present invention is actually used in a medial strip of a specific road, drivers or riders can sufficiently recognize or identify the presence of the stationary board 1*a* in nighttime or the like.

As seen in FIG. 12, in each of the plate members 5*a,* 6*a,* the inner surface of the flat-shaped central region 7 facing the hollow space is formed as a rough surface with fine irregularities. Further, referring to FIG. 12, the inner surface of the peripheral region 8 facing the hollow space is formed with a number of protrusions 18 each having a six-sided pyramid shape. In FIG. 12, the reference symbol P indicates the central plane of the plate assembly 3*a*.

As with the first embodiment, the column support 4 constituting the stationary board 1*a* in the second embodiment is formed in a hollow structure of a plastic martial. It is not essential to provide transparency in the column support 4 as with the first embodiment.

In the medial strip 2 having a plural number of the above stationary boards 1*a* set up therealong at given intervals, for example, of 5 to 7 m, as shown in FIG. 8, the light from a vehicle in the opposite lane at night is incident on the surface of the plate assembly 3*a* of the stationary board 1*a*. Then, the incident light is scattered by the irregularities formed in the inner surface of the central region 7 and the six-sided pyramid-shaped protrusions 18 formed in the inner surface of the peripheral region 8 in each of the plate members 5*a,* 6*a*. This scattering effect prevents the light of the oncoming vehicle from dazzling or negatively influencing a driver or rider in a lane facing the light. In addition, the identification member 22 made of a plastic material containing a luminous pigment and attached to the top portion of the plate assembly 3*a* stores energy of exciting lights from outside, and emits light in dark surroundings, such as nighttime, so as to help drivers or riders identify the position of the medial strip. Furthermore, the identification member 22 molded of a plastic material containing a luminous pigment to exhibit excellent in water resistance and durability as compared to an identification portion formed by simply applying a luminous material onto the plate assembly can sufficiently bring out the original functions even in severe outdoor weather conditions.

As with the first embodiment, the plate assembly 3*a* of the stationary board 1*a* is preferably designed to have a height of 600 to 700 mm and a width of 400 to 450 mm, and is set up in the medial strip through the column support 4 at a total height of 1400 to 1500 mm.

Referring to FIG. 8, the line A indicates a direction perpendicular to the longitudinal direction of the medial strip 2, and the line B indicated a projector of the plane of the plate members serving as a principal component of the stationary board 1*a*. As seen in FIG. 8, the stationary board 1*a* is preferably arranged such that a horizontal plane or the central plane P of the plate assembly 3*a* has a given inclination θ relative to the perpendicular direction A. Preferably, the inclination θ is set in the range of 10° to 20°.

Advantageous embodiments of the present invention have been shown and described. It is obvious to those skilled in the art that various changes and modifications may be made therein without departing from the spirit and scope thereof as set forth in appended claims.

What is claimed is:

1. A stationary board adapted to be set up in a medial strip between traffic lanes to block lights of oncoming vehicles in said medial strip and facilitate identification of said medial strip in nighttime driving or riding, said stationary board comprising a pair of plate members each composed of a molded component made of a transparent plastic material, said plate members being coupled with one another at the respective marginal edges thereof to form an integrated assembly having a hollow space therein, wherein each of said plate members is formed with irregularities in its inner surface facing said hollow space of said assembly, and at least the marginal region of said inner surface has a coat layer of a luminous material thereon;

wherein each of said plate members has a central region and a peripheral region on the outside of said central region, said central region having a flat shape, the inner surface of said central region being formed as a rough surface with fine irregularities, said peripheral region having an arc shape in horizontal section, the inner surface of said peripheral region being formed with a number of pyramid-shaped protrusions in its entirely.

2. The stationary board as defined in claim 1, which is arranged such that the central plane of said plate assembly has an inclination in the range of 10° to 20° relative to a direction perpendicular to the longitudinal direction of the medial strip.

3. A stationary board adapted to be set up in a medial strip between traffic lanes to block lights of oncoming vehicles in said medial strip and facilitate identification of said medial strip in nighttime driving or riding, said stationary board comprising:

a pair of plate members each composed of a molded component made of a transparent plastic material, said plate members being coupled with one another at the respective marginal edges thereof to form an integrated assembly having a hollow space therein, each of said plate members being formed with irregularities in its inner surface facing said hollow space of said assembly; and a top member molded of a plastic resin material containing a luminous pigment and attached to the top portion of said assembly;

wherein each of said plate members has a central region and a peripheral region on the outside of said central region, said central region having a flat shape, the inner surface of said central region being formed as a rough surface with fine irregularities, said peripheral region having an arc shape in horizontal section, the inner surface of said peripheral region being formed with a number of pyramid-shaped protrusions in its entirety.

4. The stationary board as defined in claim 3, which is arranged such that the horizontal central plane of said plate assembly has an inclination in the range of 10° to 20° relative to a direction perpendicular to the longitudinal direction of the medial strip.

5. The stationary board as defined in claim 3, which is arranged such that the horizontal central plane of said plate assembly has an inclination in the range of 10° to 20° relative to a direction perpendicular to the longitudinal direction of the medial strip.

6. The stationary board as defined in claim 3 wherein the plastic molded top member has a plurality of pawls and the assembly has depressions at positions allowing the pawls to be received therein, and wherein the top member is attached to the top portion of the assembly by fitting the pawis into the depressions.

* * * * *